US009689283B2

(12) United States Patent
Kobayashi et al.

(10) Patent No.: US 9,689,283 B2
(45) Date of Patent: Jun. 27, 2017

(54) VALVE OPENING/CLOSING TIMING CONTROL DEVICE

(71) Applicant: AISIN SEIKI KABUSHIKI KAISHA, Kariya-shi, Aichi (JP)

(72) Inventors: Masaki Kobayashi, Okazaki (JP); Yoshiaki Yamakawa, Toyota (JP); Hiroyuki Amano, Kariya (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 28 days.

(21) Appl. No.: 14/772,673

(22) PCT Filed: Nov. 14, 2014

(86) PCT No.: PCT/JP2014/080245
§ 371 (c)(1),
(2) Date: Sep. 3, 2015

(87) PCT Pub. No.: WO2015/145862
PCT Pub. Date: Oct. 1, 2015

(65) Prior Publication Data

US 2016/0108770 A1 Apr. 21, 2016

(30) Foreign Application Priority Data

Mar. 26, 2014 (JP) ..... 2014-064371

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/3443* (2013.01);
(Continued)

(58) Field of Classification Search
CPC . F01L 1/344; F01L 1/3442; F01L 2001/3443; F01L 2001/34433
(Continued)

(56) References Cited

U.S. PATENT DOCUMENTS 6,257,207 B1 7/2001 Inui et al.
6,505,586 B1 1/2003 Sato et al.
(Continued)

FOREIGN PATENT DOCUMENTS

JP 10-159514 A 6/1998
JP 2000-80942 A 3/2000
(Continued)

OTHER PUBLICATIONS

International Search Report (Form PCT/ISA/210) issued on Feb. 10, 2015, by the Japanese Patent Office as the International Searching Authority for International Application No. PCT/JP2014/080245, and English Translation.
(Continued)

*Primary Examiner* — Ching Chang
(74) *Attorney, Agent, or Firm* — Buchanan Ingersoll & Rooney PC

(57) ABSTRACT

A valve opening/closing timing control device is configured to be capable of appropriately setting a valve opening/closing timing within a short period of time from start-up of an internal combustion engine. An advancing chamber and a retarding chamber for relative phase control are formed between a driving rotating body that rotates synchronously with a drive shaft of an internal combustion engine and a driven rotating body that rotates integrally with a valve opening/closing camshaft, and a lock mechanism that locks the relative rotation phase at a locked phase is provided. During start-up of the internal combustion engine, a controller starts fluid-filling control for filling the advancing
(Continued)

chamber and the retarding chamber with a fluid, and performs unlock control for releasing a locked state of the lock mechanism before filling of the fluid by the fluid-filling control is completed.

8 Claims, 7 Drawing Sheets

(52) U.S. Cl.
CPC ..... *F01L 2001/34433* (2013.01); *F01L 2001/34459* (2013.01); *F01L 2001/34463* (2013.01); *F01L 2001/34466* (2013.01); *F01L 2001/34473* (2013.01); *F01L 2001/34479* (2013.01); *F01L 2001/34483* (2013.01); *F01L 2250/02* (2013.01); *F01L 2250/04* (2013.01); *F01L 2800/01* (2013.01); *F01L 2800/03* (2013.01)

(58) Field of Classification Search
USPC ..... 123/90.15, 90.17
See application file for complete search history.

(56) References Cited

U.S. PATENT DOCUMENTS

| | | | | |
|---|---|---|---|---|
| 9,243,522 | B2 * | 1/2016 | Kobayashi | F02D 13/0219 123/90.17 |
| 2003/0121486 | A1 | 7/2003 | Komazaawa et al. | |
| 2010/0139593 | A1 | 6/2010 | Takemura | |
| 2014/0041606 | A1 | 2/2014 | Kobayashi | |
| 2015/0114329 | A1 | 4/2015 | Kobayashi | |

FOREIGN PATENT DOCUMENTS

| | | | |
|---|---|---|---|
| JP | 2001-50064 | A | 2/2001 |
| JP | 2001-289013 | A | 10/2001 |
| JP | 3867897 | B2 | 1/2007 |
| JP | 2007-154748 | | 6/2007 |
| JP | 2010-138698 | A | 6/2010 |
| JP | 4531705 | B2 | 8/2010 |
| JP | 2013-256929 | A | 12/2013 |
| JP | 2014-34914 | A | 2/2014 |

OTHER PUBLICATIONS

U.S. Appl. No. 14/772,164, filed Sep. 2, 2015, Kobayashi et al.
International Search Report (PCT/ISA/210) mailed on Feb. 10, 2015, by the Japanese Patent Office as the International Searching Authority for International Application No. PCT/JP2014/080245.
Written Opinion (PCT/ISA/237) mailed on Feb. 10, 2015, by the Japanese Patent Office as the International Searching Authority for International Application No. PCT/JP2014/080245.
Notification of Transmittal of Translation of the International Preliminary Report on Patentability (Form PCT/IB/338 and Form/PCT/IB/373) and the Translation of the Written Opinion of the International Searching Authority (Form PCT/ISA/237) issued on Oct. 6, 2016, by the International Bureau of WIPO in corresponding International Application No. PCT/JP2014/080245. (11 pgs).

* cited by examiner

Fig.3

| Supply power | 0 ← → Maximum | | | | |
|---|---|---|---|---|---|
| Position | W1 | W2 | W3 | W4 | W5 |
| Advancing channel | Supply | | Close | Discharge | |
| Retarding channel | Discharge | | Close | Supply | |
| Unlocking channel | Discharge | Supply | | | Close |
| Lock discharge channel | Discharge | Close | | | Discharge |

Fig.4

| Supply power | 0 ← → Maximum | | | | |
|---|---|---|---|---|---|
| Position | W1 | W2 | W3 | W4 | W5 |
| Advancing channel | Discharge | | Close | Supply | |
| Retarding channel | Supply | | Close | Discharge | |
| Unlocking channel | Discharge | Supply | | | Close |
| Lock discharge channel | Discharge | Close | | | Discharge |

VALVE OPENING/CLOSING TIMING CONTROL DEVICE

TECHNICAL FIELD

The present invention relates to a valve opening/closing timing control device. More specifically, the present invention relates to an improved valve opening/closing timing control device having a driving rotating body that rotates synchronously with a drive shaft of an internal combustion engine and a driven rotating body that is disposed coaxially with the driving rotating body and that rotates integrally with a camshaft for opening/closing a valve of the internal combustion engine, and also including a lock mechanism that keeps the relative rotation phase of the driving rotating body and the driven rotating body at a predetermined phase when the internal combustion engine is stopped.

BACKGROUND ART

A conventional valve opening/closing timing control device includes a lock mechanism and thus maintains the relative rotation phase at a locked phase even when a fluid pressure provided by a pump is low during start-up of the internal combustion engine. Moreover, after the start-up of the internal combustion engine, the valve opening/closing timing control device releases the locking by the lock mechanism and controls the relative rotation phase using the fluid that is supplied from the pump.

During start-up of the internal combustion engine, the lock mechanism is maintained in a locked state, but after the start-up of the internal combustion engine, it is necessary to quickly adjust the valve opening/closing timing by changing the relative rotation phase of the valve opening/closing timing control device.

To address this issue, Patent Document 1 discloses a mode of control in which during start-up of an internal combustion engine, one of an advancing chamber and a retarding chamber for displacing the relative rotation phase in an advance direction and a retard direction, respectively, of a valve opening/closing timing control device, is filled with a fluid, subsequently the other of the advancing chamber and the retarding chamber is filled with the fluid, and then a lock mechanism is unlocked.

Also, Patent Document 2 discloses a hydraulic control valve including an electromagnetic solenoid that controls the relative rotation phase of a driving rotating body and a driven rotating body of a valve opening/closing timing control device and that controls the lock status of a lock mechanism. This hydraulic control valve is configured so as to control the supply/discharge of a fluid to/from the advancing chamber and the retarding chamber as well as the supply/discharge of the fluid to/from the lock mechanism by operating a single spool using the solenoid.

CITATION LIST

Patent Literature

Patent Document 1: Japanese Patent No. 4531705
Patent Document 2: Japanese Patent No. 3867897

SUMMARY OF INVENTION

Technical Problem

In the valve opening/closing timing control device in which the fluid from the pump that is driven by the internal combustion engine is supplied and discharged via the hydraulic control valve, the lock mechanism is maintained in the locked state during start-up of the internal combustion engine. Control is performed such that after a predetermined period of time has elapsed from the start-up, and a situation is reached in which a fluid pressure that is sufficient for activating the valve opening/closing timing control device is achieved, the locked state of the lock mechanism is released.

Moreover, in an ordinary valve opening/closing timing control device, the fluid slightly leaks out of the advancing chamber and the retarding chamber. Thus, when the internal combustion engine is to be started after a long period of time has elapsed from a stop of the internal combustion engine, almost no fluid is present in the advancing chamber and the retarding chamber. As a result, when the lock mechanism is unlocked, a torque that is exerted from the camshaft causes the relative rotation phase of the driving rotating body and the driven rotating body to be significantly changed in the advance direction or the retard direction.

In order to eliminate such a change in the relative rotation phase, a configuration is conceivable in which, as disclosed in Patent Document 1, during start-up of the internal combustion engine, the advancing chamber and the retarding chamber are filled with the fluid before the lock mechanism is unlocked.

However, in the configuration in which the advancing chamber and the retarding chamber are filled with the fluid, it takes time until it becomes possible to change the relative rotation phase of the valve opening/closing timing control device after start-up of the internal combustion engine, and there is room for improvement.

It is an object of the present invention to reasonably construct a valve opening/closing timing control device that is capable of controlling the opening/closing timing of a valve promptly after start-up of the internal combustion engine.

Solution to Problem

The present invention is characterized in that a valve opening/closing timing control device includes a driving rotating body that rotates synchronously with a drive shaft of an internal combustion engine; a driven rotating body that is disposed coaxially with the driving rotating body and that rotates integrally with a camshaft for opening/closing a valve of the internal combustion engine; a lock mechanism that is capable of switching between a locked state in which a relative rotation phase of the driving rotating body and the driven rotating body is kept at a predetermined locked phase and an unlocked state; a fluid pressure chamber that is defined between the driving rotating body and the driven rotating body; a control valve mechanism that controls supply of a fluid to an advancing chamber and a retarding chamber, of the fluid pressure chamber, the supply to the advancing chamber causing the relative rotation phase to be displaced in an advance direction, and the supply to the retarding chamber causing the relative rotation phase to be displaced in a retard direction, and that controls supply of the fluid for controlling the lock mechanism; and a controller that controls the control valve mechanism, wherein during start-up of the internal combustion engine, the controller performs unlock control for releasing the locked state of the lock mechanism before filling of the advancing chamber and the retarding chamber with the fluid by fluid-filling control is completed.

With this configuration, during start-up of the internal combustion engine, the advancing chamber and the retarding chamber are filled with the fluid by the fluid-filling control, and before the filling of these chambers is completed, the locked state of the lock mechanism is released by the unlock control. Setting the mode of control in this manner reduces the time from the start-up of the internal combustion engine to the unlocking when compared with a case where, for example, the locked state of the lock mechanism is released after the filling of the advancing chamber and the retarding chamber with the fluid is completed. Moreover, even in the case where a rotational torque is exerted from the camshaft after the locked state of the lock mechanism is released, a change in the relative rotation phase can be suppressed by the filled fluid. Accordingly, the valve opening/closing timing control device is configured to be capable of controlling the valve opening/closing timing promptly after start-up of the internal combustion engine.

According to the present invention, it is also possible that a filling order of the fluid-filling control is set such that after filling of either one of the advancing chamber and the retarding chamber with the fluid is completed, filling of the other of the advancing chamber and the retarding chamber with the fluid is started, and the unlock control is performed such that after the filling of either one of the advancing chamber and the retarding chamber with the fluid is completed and before the filling of the other of the advancing chamber and the retarding chamber is completed, the fluid is supplied in a direction in which the lock mechanism is unlocked.

If either one of the advancing chamber and the retarding chamber has already been filled with the fluid, after the locked state of the lock mechanism is released, regardless of whether the rotational torque from the camshaft acts in a direction in which a portion filled with the fluid is compressed or a direction in which that portion is expanded, the fluid suppresses movement of the driven rotating body. Therefore, the relative rotation phase is not significantly changed in the advance direction or the retard direction.

According to the present invention, it is also possible that after the unlock control, the controller controls the control valve mechanism such that the fluid is supplied to either the advancing chamber or the retarding chamber, the fluid supplied to said advancing chamber or retarding chamber acting against a direction of a displacement of the relative rotation phase due to a torque of the camshaft that is exerted from the camshaft.

The control valve mechanism is configured such that when the fluid is supplied to one of the advancing chamber and the retarding chamber, the fluid is discharged from the other. Accordingly, when the locked state of the lock mechanism is released, if the pressure due to the torque of the camshaft acts to reduce the chamber from which the fluid is to be discharged, the problem of the relative rotation phase of the driving rotating body and the driven rotating body being easily displaced occurs. For this reason, after the unlock control, the fluid is supplied to a chamber whose volume is to be reduced by the torque of the camshaft, of the advancing chamber and the retarding chamber, and the displacement of the relative rotation phase can thus be suppressed.

According to the present invention, it is also possible that after the unlock control, the controller controls the control valve mechanism such that the relative rotation phase is maintained at the locked phase.

With this configuration, after the lock mechanism is unlocked, if the relative rotation phase comes off the locked phase, the fluid is supplied to one of the advancing chamber and the retarding chamber, and thus the relative rotation phase can be maintained at the locked phase. Accordingly, warming-up and the like immediately after start-up can be stably performed.

According to the present invention, it is also possible that after the start-up of the internal combustion engine, the controller starts the unlock control at the time when a peak of discharge of unburned HC is passed.

In the internal combustion engine, the fuel that has not been burned immediately after start-up is discharged as unburned HC. That amount of this unburned HC increases to the maximum at the point in time when several seconds have elapsed from the start-up of the internal combustion engine. A phase that reduces the unburned HC is set as the locked phase of the valve opening/closing timing control device. However, setting the unlocking timing of the lock mechanism as described above makes it possible to change the valve opening/closing timing while maintaining the suppression of the increase in the unburned HC.

The present invention is characterized in that a valve opening/closing timing control device includes a driving rotating body that rotates synchronously with a drive shaft of an internal combustion engine; a driven rotating body that is disposed coaxially with the driving rotating body and that rotates integrally with a camshaft for opening/closing a valve of the internal combustion engine; a lock mechanism that is capable of switching between a locked state in which a relative rotation phase of the driving rotating body and the driven rotating body is kept at a predetermined locked phase and an unlocked state; a fluid pressure chamber that is defined between the driving rotating body and the driven rotating body; a control valve mechanism that controls supply of a first fluid to an advancing chamber and a retarding chamber, of the fluid pressure chamber, the supply to the advancing chamber causing the relative rotation phase to be displaced in an advance direction, and the supply to the retarding chamber causing the relative rotation phase to be displaced in a retard direction, and that controls supply of the first fluid for controlling the lock mechanism; and a controller that controls the control valve mechanism, wherein the controller performs unlocking at a point in time when a period of time of filling for which either the advancing chamber or the retarding chamber is filled with the first fluid from start-up of the internal combustion engine exceeds a set period of time that is set during the start-up of the internal combustion engine in accordance with the temperature of the first fluid or a second fluid for use in adjustment of the temperature of the internal combustion engine.

With this configuration, during start-up of the internal combustion engine, a period of time of filling for which either one of the advancing chamber and the retarding chamber is filled with the first fluid is set in accordance with the temperature of the first fluid or the second fluid. That is to say, a period of time of filling that is suited to the viscosity corresponding to the temperature of the first fluid or the second fluid is set. Unlocking is performed at the point in time when a period of time that is set as this period of time of filling is exceeded. With this configuration, the time from the start-up of the internal combustion engine to the unlocking is reduced when compared with a case where, for example, the locked state of the lock mechanism is released after filling of the advancing chamber and the retarding chamber with the fluid is completed. Moreover, even in the case where a rotational torque is exerted from the camshaft after the locked state of the lock mechanism is released, a change in the relative rotation phase can be suppressed by the filled fluid.

BRIEF DESCRIPTION OF DRAWINGS

FIG. 3 shows supply/discharge of a working oil with respect to set positions of a spool of a control valve mechanism.

FIG. 4 shows discharge/supply of the working oil with respect to set positions of the spool of the control valve mechanism according to a variation.

DESCRIPTION OF EMBODIMENTS

Hereinafter, embodiments of the present invention will be described based on the drawings.

[Overall Configuration]

Figure 1:
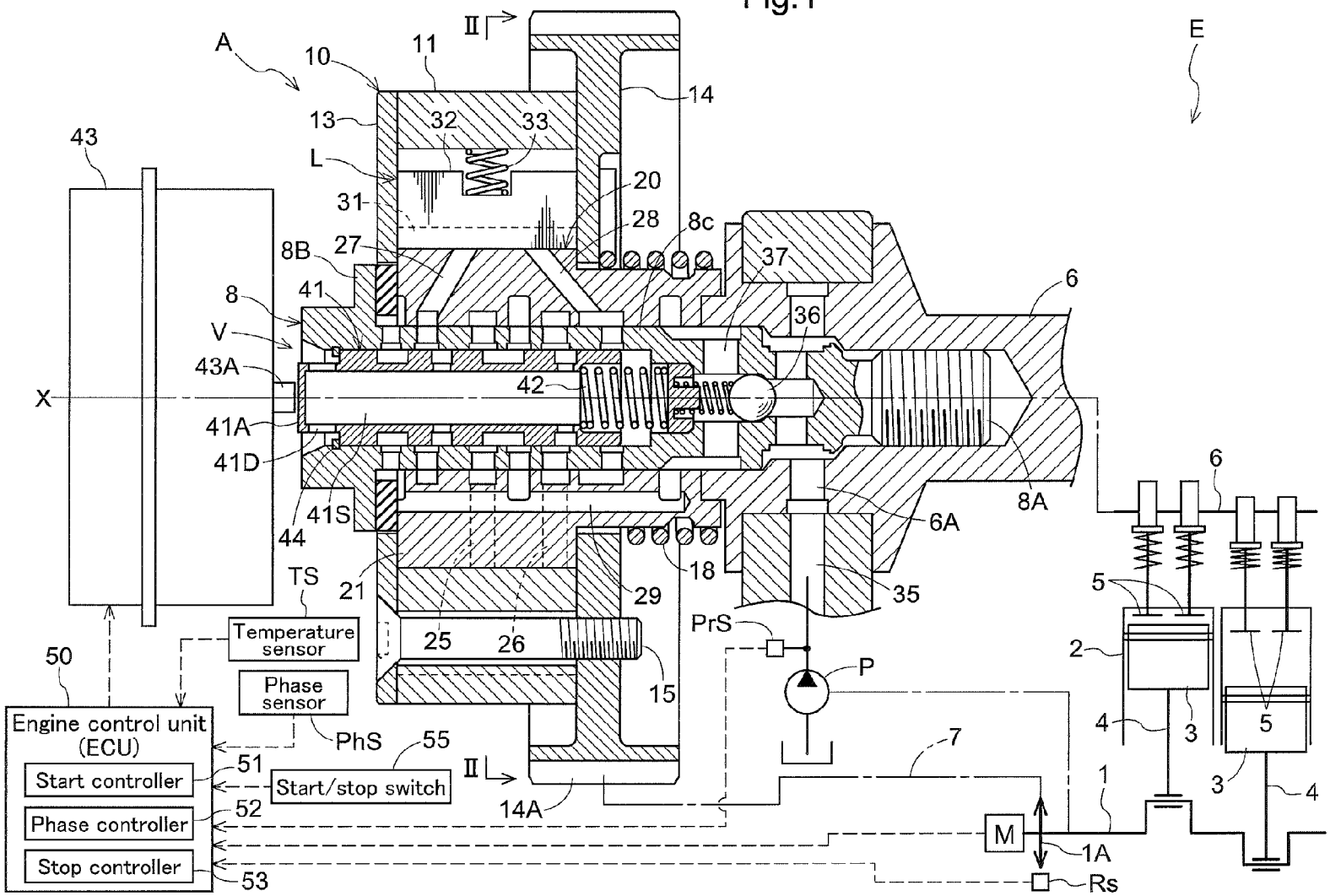
FIG. 1 is a diagram showing the configuration of a valve opening/closing timing control device.
Figure 2:
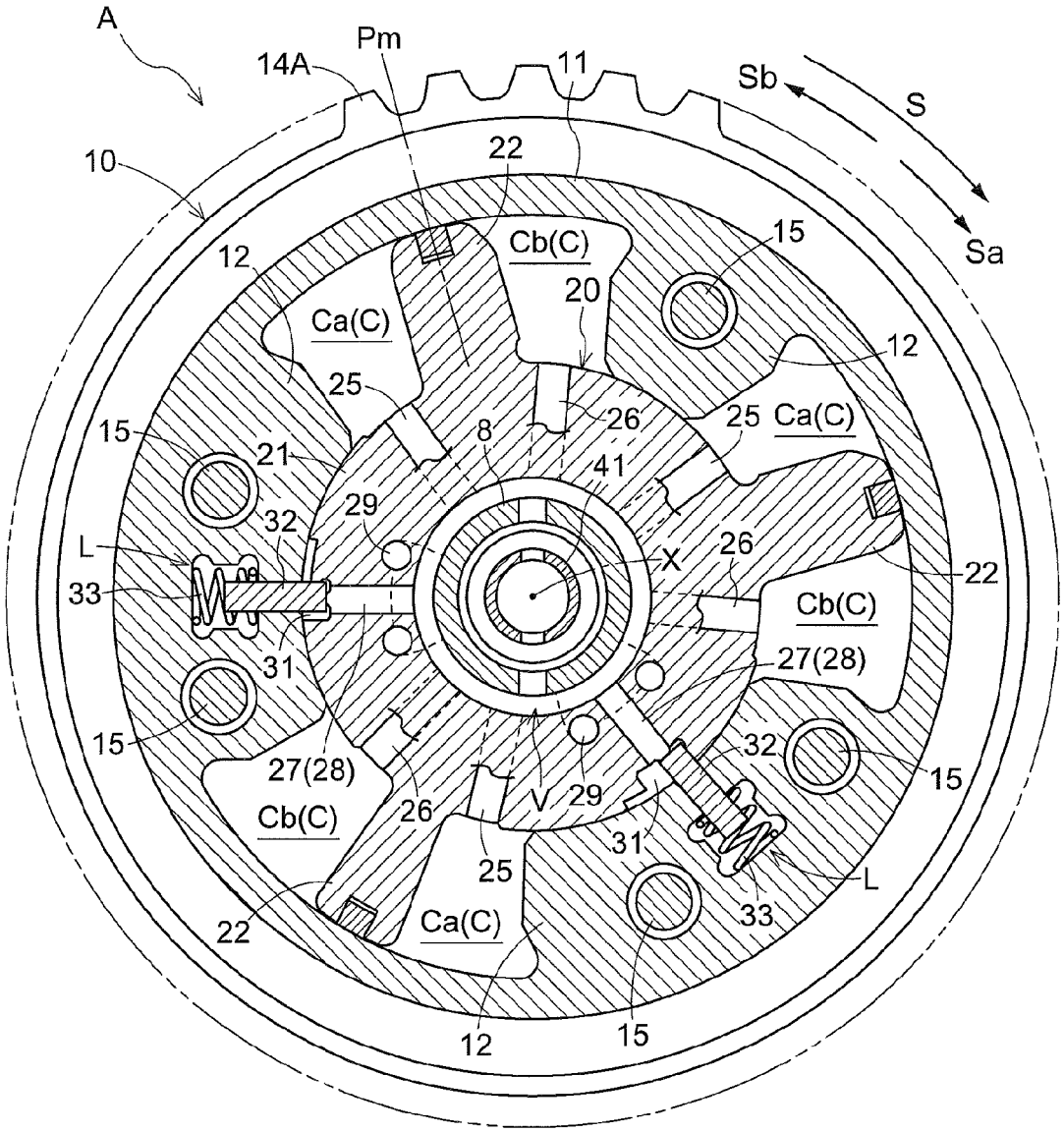
FIG. 2 is a cross-sectional view taken along line II-II in FIG. 1.

As shown in FIGS. 1 and 2, a valve opening/closing timing control unit A is configured including an outer rotor 10, which is a driving rotating body, an inner rotor 20, which is a driven rotating body, and a lock mechanism L that keeps a relative rotation phase of the outer rotor 10 and the inner rotor 20 at an intermediate locked phase Pm. A valve opening/closing timing control device is configured including this valve opening/closing timing control unit A, a control valve mechanism V that controls the relative rotation phase and the lock mechanism L, of the valve opening/closing timing control unit A, and an engine control unit 50, which is a controller that controls this control valve mechanism V.

An engine E (an example of an internal combustion engine) shown in FIG. 1 is an engine that is provided in a vehicle such as a passenger automobile. The engine E is configured as a four-stroke cycle engine that includes a cylinder block 2 in an upper portion of a casing rotatably supporting a crankshaft 1 (an example of a drive shaft) and that transfers the operating force of a piston 3 accommodated in a cylinder bore of this cylinder block 2 to the crankshaft 1 via a connecting rod 4. An intake valve 5 and an exhaust valve (not shown) are provided in an upper portion of the cylinder block 2, and an intake camshaft 6 (an example of a camshaft) that is operable to open/close the intake valve 5 and an exhaust camshaft (not shown) that is operable to open/close the exhaust valve are provided.

The outer rotor 10 is disposed coaxially with a rotation axis X of the intake camshaft 6. The inner rotor 20 is connected to the intake camshaft 6 by a fixing bolt 8 such that the inner rotor 20 is rotatable integrally with the intake camshaft 6 in a state in which the inner rotor 20 is housed in the outer rotor 10.

As described later, the valve opening/closing timing control unit A controls the supply/discharge of a working oil (a specific example of a fluid/a first fluid) to/from an advancing chamber Ca and a retarding chamber Cb that are formed between the outer rotor 10 (an example of the driving rotating body) and the inner rotor 20 (an example of the driven rotating body), thereby displacing the relative rotation phase of the outer rotor 10 and the inner rotor 20. The opening/closing timing of the intake valve 5 of the engine E (an example of an internal combustion engine) is controlled by displacing this relative rotation phase. The lock mechanism L enables a transition to an unlocked state (unlocked state) and a transition to a locked state by the supply/discharge of the working oil. The control valve mechanism V performs the supply/discharge of the working oil to/from the advancing chamber Ca and the retarding chamber Cb and also performs the supply/discharge of the working oil for controlling the lock mechanism L. Moreover, the engine E is configured such that the temperature thereof is adjusted using a coolant, which is a second fluid.

The engine control unit 50 is configured as an ECU, and controls the relative rotation phase of the valve opening/closing timing control unit A based on information such as the rotation speed of the engine E, the temperature of the engine E, a load applied to the engine E, or the like, in order to set an intake timing (the timing of intake) that provides a favorable fuel efficiency or an intake timing that provides a required torque.

Moreover, the engine control unit 50 performs control to transition the lock mechanism L to the locked state during stoppage of the engine E and to transition the lock mechanism L to the unlocked state during start-up of the engine E. Details of the control for the transition to the unlocked state will be described later.

It should be noted that the valve opening/closing timing control unit A of the present invention may be provided for the exhaust camshaft so as to control the opening/closing timing of the exhaust valve, or may be provided for both the intake camshaft 6 and the exhaust camshaft.

[Valve Opening/Closing Timing Control Unit]

The outer rotor 10 includes a cylindrical rotor main body 11, a front plate 13 that is located away from the engine E in a direction along the rotation axis X, and a rear plate 14 that is located close to the engine E, and these components are fastened together by a fastening bolt 15 and thus integrated into a single unit. Moreover, a timing pulley portion 14A is formed integrally with an outer circumference of the rear plate 14, and a timing belt 7 is placed around this timing pulley portion 14A and an output pulley 1A that is provided for the crankshaft 1.

With this configuration, the crankshaft 1 of the engine E and the outer rotor 10 rotate synchronously. It should be noted that in order to allow the crankshaft 1 and the outer rotor 10 to rotate synchronously, for example, a timing chain may also be used, or a gear train having a plurality of gears may also be disposed between the crankshaft 1 and the outer rotor 10.

A plurality of (three in this embodiment) protrusions 12 are formed on an inner circumference of the rotor main body 11, protruding in a direction toward the rotation axis X (a direction toward the center point). This formation of the plurality of protrusions 12 allows a plurality of fluid pressure chambers C to be formed between the inner circumference of the rotor main body 11 and an outer circumferential portion of the inner rotor 20.

The inner rotor 20 is disposed in a position sandwiched between the front plate 13 and the rear plate 14 and is rotatable about the rotation axis X relative to the outer rotor 10. This inner rotor 20 has a structure in which a plurality of (three in this embodiment) vane portions 22 are formed integrally with an outer circumferential surface of a circular column-shaped portion 21 that is coaxial with the rotation axis X. Protruding ends of the protrusions 12 of the rotor main body 11 are brought into contact with the outer circumference of the circular column-shaped portion 21, and protruding ends of the vane portions 22 are brought into contact with the inner circumference of the rotor main body 11. With this configuration, each fluid pressure chamber C is divided by the corresponding vane portion 22, and thus the advancing chamber Ca and the retarding chamber Cb are formed.

The valve opening/closing timing control unit A rotates in a driving rotation direction S when the engine E is operating. A direction in which the inner rotor 20 is displaced in a direction that is the same as the driving rotation direction S relative to the outer rotor 10 will be referred to as an advance direction Sa, and a direction in which the inner rotor 20 is displaced in a direction that is opposite to the driving rotation direction S relative to the outer rotor 10 will be referred to as a retard direction Sb.

With this configuration, the supply of the working oil to the advancing chambers Ca causes a displacement of the relative rotation phase in the advance direction Sa, and the supply of the working oil to the retarding chambers Cb causes a displacement of the relative rotation phase in the retard direction Sb.

A relative rotation phase in a state in which the vane portions 22 have each reached a moving end (end of oscillation about the rotation axis X) in the advance direction Sa will be referred to as the maximum advance phase, and a relative rotation phase in a state in which the vane portions 22 have each reached a moving end (end of oscillation about the rotation axis X) in the retard direction Sb will be referred to as the maximum retard phase. It should be noted that the concept of the maximum advance phase includes not only the moving ends of the vane portions 22 in the advance direction Sa but also the vicinities of these moving ends. Similarly, the concept of the maximum retard phase includes not only the moving ends of the vane portions 22 in the retard direction Sb but also the vicinities of these moving ends.

Moreover, a torsion spring 18 is provided between the outer rotor 10 and the inner rotor 20, the torsion spring 18 exerting a biasing force in the advance direction Sa in a region in which the relative rotation phase is displaced from the maximum retard phase to the intermediate locked phase Pm. The torsion spring 18 is configured such that when the relative rotation phase moves past the intermediate locked phase Pm in the advance direction Sa, no biasing force and no resistance are exerted.

[Valve Opening/Closing Timing Control Unit: Lock Mechanism]

The lock mechanism L is constituted by a lock recess 31 that is formed in the outer circumference of the circular column-shaped portion 21 of the inner rotor 20, a plate-shaped lock member 32 that is supported so as to be retractable in a radial direction into the corresponding protrusion 12 of the outer rotor 10, and a lock spring 33 that biases this lock member 32 toward the lock recess 31.

Two of said lock recesses 31 are formed at two positions in the outer circumference of the circular column-shaped portion 21, and two of said lock members 32 corresponding to the two lock recesses 31 are formed in the two protrusions 12. Moreover, a relative position in which the lock members 32 simultaneously engage with the corresponding lock recesses 31 at the two positions is referred to as the intermediate locked phase Pm. This intermediate locked phase Pm is set as a phase that separates a maximum advance phase region and a maximum retard phase region from each other. The intermediate locked phase Pm is the phase that is most suitable for stable start-up of the engine E.

[Variations of Lock Mechanism]

The lock mechanism L may also have a configuration in which a lock member 32 is supported by the inner rotor 20 in a retractable manner, and a lock recess 31 engageable with this lock member 32 is formed in the outer rotor 10. Alternatively, the lock mechanism L may have a configuration in which a lock member 32 that is retractable in a direction parallel to the rotation axis X is supported by the outer rotor 10 or the inner rotor 20, and a lock recess 31 engageable with this lock member 32 is formed in the inner rotor 20 or the outer rotor 10.

[Valve Opening/Closing Timing Control Unit: Oil Channel Configuration]

In the circular column-shaped portion 21 of the inner rotor 20, advancing channels 25 that are in communication with the advancing chambers Ca and retarding channels 26 that are in communication with the retarding chambers Cb are formed, and also unlocking channels 27 and lock discharge channels 28 that are in communication with the lock recesses 31 are formed.

With this oil channel configuration, the relative rotation phase is displaced in the advance direction Sa by supplying the working oil to the advancing chambers Ca while discharging the working oil from the retarding chambers Cb, and the relative rotation phase is displaced in the retard direction Sb by supplying the working oil to the retarding chambers Cb while discharging the working oil from the advancing chambers Ca.

Moreover, when the relative rotation phase has reached the intermediate locked phase Pm in a state in which the working oil is discharged through the unlocking channels 27 and the lock discharge channels 28, the biasing force of the lock springs 33 allows the two lock members 32 to engage with the corresponding lock recesses 31, and thus the locked state is achieved. Conversely, when the lock discharge channels 28 are closed while the working oil is supplied to the unlocking channels 27, the lock members 32 are disengaged from the lock recesses 31 against the biasing force of the lock springs 33, and thus the locked state is released. The supply/discharge of the working oil during the transition to the locked state and during the releasing of the locked state, of the lock mechanism L, will be described later.

In the fixing bolt 8, as shown in FIG. 1, a male screw portion 8A that is screwed into the intake camshaft 6 is formed at a leading end, a bolt head portion 8B is formed at a rear end, and a tubular portion 8C that is coaxial with the rotation axis X and that has a circular cross-sectional shape is formed in an intermediate portion.

A supply oil channel 35 to which the working oil is supplied from a hydraulic pump P driven by the engine E is formed in a constituent member of the engine E, and a relay oil channel 6A to which the working oil from the supply oil channel 35 is supplied is formed in the intake camshaft 6. Within the fixing bolt 8, a ball check valve 36 that is openable by the pressure of the working oil supplied through the relay oil channel 6A, and an intermediate channel 37 to which the working oil is supplied through the check valve 36 are formed. A plurality of (four) distribution channels 29 to which the working oil from the intermediate channel 37 is supplied are formed in the circular column-shaped portion 21 of the inner rotor 20, the distribution channels 29 being parallel to the rotation axis X.

It should be noted that the hydraulic pump P is configured so as to supply lubricating oil that is stored in an oil pan of the engine E, which serves as the working oil, to the control valve mechanism V.

[Control Valve Mechanism]

As shown in FIG. 1, the control valve mechanism V is configured including a spool 41 that is accommodated in the tubular portion 8C of the fixing bolt 8, a spool spring 42 that biases this spool 41 outward (leftward in FIG. 1), and an electromagnetic solenoid 43 that is operable to move the spool 41 inward. In this control valve mechanism V, the spool 41 is configured to be rotatable integrally with the inner rotor 20, whereas the electromagnetic solenoid 43 is supported by the engine E and is rotatable relative to the spool 41.

With this control valve mechanism V, the flow of the working oil to the advancing channels 25, the retarding channels 26, the unlocking channels 27, and the lock discharge channels 28 is controlled by setting the single spool 41 in any of five positions (W1 to W5) shown in FIG. 3 by means of the electromagnetic solenoid 43. It should be noted that as a variation of this control valve mechanism V, for example, a configuration in which the flow of the working oil is controlled as shown in FIG. 4 may also be adopted. The control valve mechanism V having this configuration is obtained by interchanging the advancing channels 25 and the retarding channels 26 of a configuration that is equal to that shown in FIG. 3. Although the power value supplied to the electromagnetic solenoid 43 during control is opposite to that of the configuration shown in FIG. 3, the same functions as those of the configuration shown in FIG. 3 are provided.

In the tubular portion 8C, two pump ports that are in communication with the distribution channels 29, an advancing port that is in communication with the advancing channels 25, a retarding port that is in communication with the retarding channels 26, an unlocking port that is in communication with the unlocking channels 27, and a lock discharge port that is in communication with the lock discharge channels 28 are formed.

In the spool 41, a pressing wall 41A is formed on an outward end side, a drain space 41S that is coaxial with the rotation axis X is formed inside, and drain holes 41D through which the working oil from the drain space 41S is discharged to the outside are formed on the outward end side. Moreover, in the outer circumference of the spool 41, a pair of drain grooves Gd that are in communication with the drain space 41S, a first control groove G1 that is used to control the working oil and that is located on the outward end side, and a second control groove G2 that is located closer to the intake camshaft 6 than the first control groove G1 is are formed as grooves that individually extend over the entire circumference.

The electromagnetic solenoid 43 includes a plunger 43A that is moved in accordance with a supplied current value, and is configured to be able to set the spool 41 in the second to fifth positions W2 to W5 by setting the power supplied to the electromagnetic solenoid 43 in a stepwise manner. In a state in which no power is supplied to the electromagnetic solenoid 43, the spool 41 is set in the first position W1 in which the spool 41 abuts against a stopper 44 provided in the fixing bolt 8. It should be noted that if a maximum power is supplied to the electromagnetic solenoid 43, the spool 41 reaches an inward moving limit and is thus set in the fifth position W5.

[Control Valve Mechanism: First Position]

Figure 5:
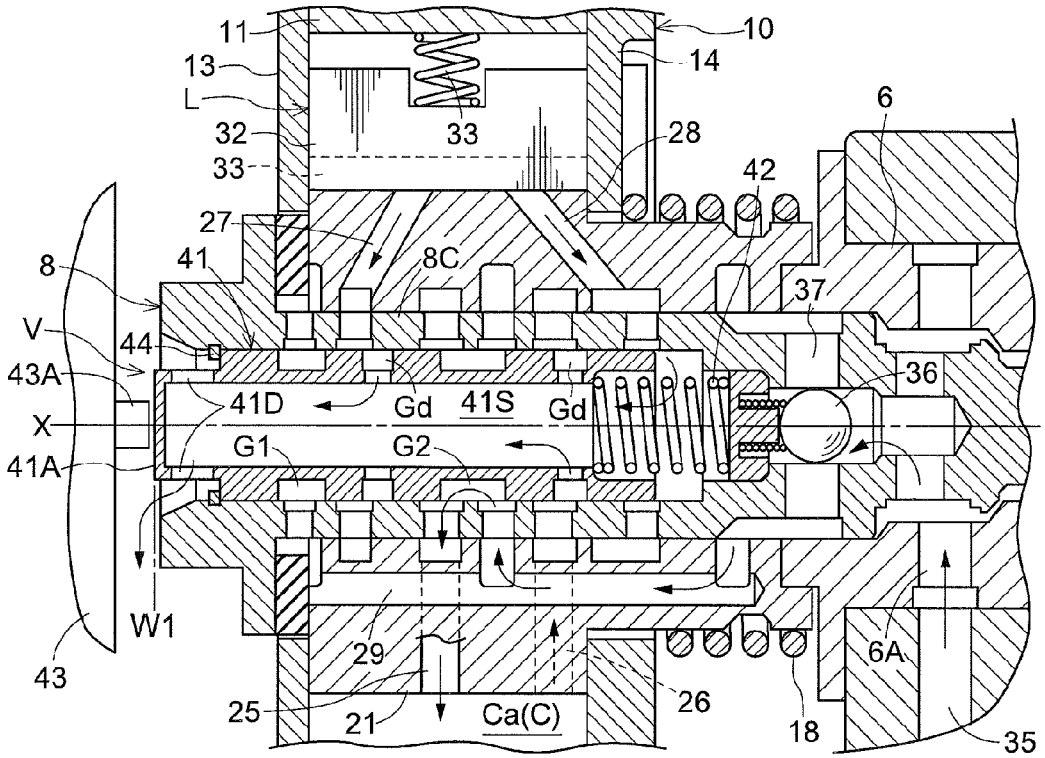
FIG. 5 is a cross-sectional view showing the flow of the working oil when the spool is set in a first position.

In the first position W1, the spool 41 is located in a position where it abuts against the stopper 44 due to the biasing force of the spool spring 42, and the working oil flows as indicated by the arrows in FIG. 5. Specifically, a pump port, which is in communication with the distribution channels 29, of the tubular portion 8C is in communication with the advancing channels 25 via the second control groove G2 of the spool 41. Moreover, the retarding port, which is in communication with the retarding channels 26, of the tubular portion 8C is in communication with the drain space 41 S via a drain groove Gd of the spool 41.

Furthermore, the unlocking port, which is in communication with the unlocking channels 27, of the tubular portion 8C is in communication with a drain groove Gd of the spool 41. Moreover, the unlocking port, which is in communication with the lock discharge channels 28, of the tubular portion 8C is in communication with the drain space 41S of the spool 41 via an inward end portion of the spool 41.

Thus, in a situation in which the engine E is operating and the lock mechanisms L are in the unlocked state, if the spool 41 is set in the first position W1, the working oil is supplied to the advancing chambers Ca while the working oil in the retarding chambers Cb is discharged. Therefore, the relative rotation phase is displaced in the advance direction Sa. If the relative rotation phase reaches the intermediate locked phase Pm due to this displacement, the biasing force of the lock springs 33 causes the pair of lock members 32 to be fitted into the corresponding lock recesses 31, and thus the lock mechanisms L are transitioned to the locked state. If the lock mechanisms L have already been in the locked state, the locked state is maintained. It should be noted that the working oil discharged into the drain space 41S is discharged to the outside through the drain holes 41D.

[Control Valve Mechanism: Second Position]

Figure 6:
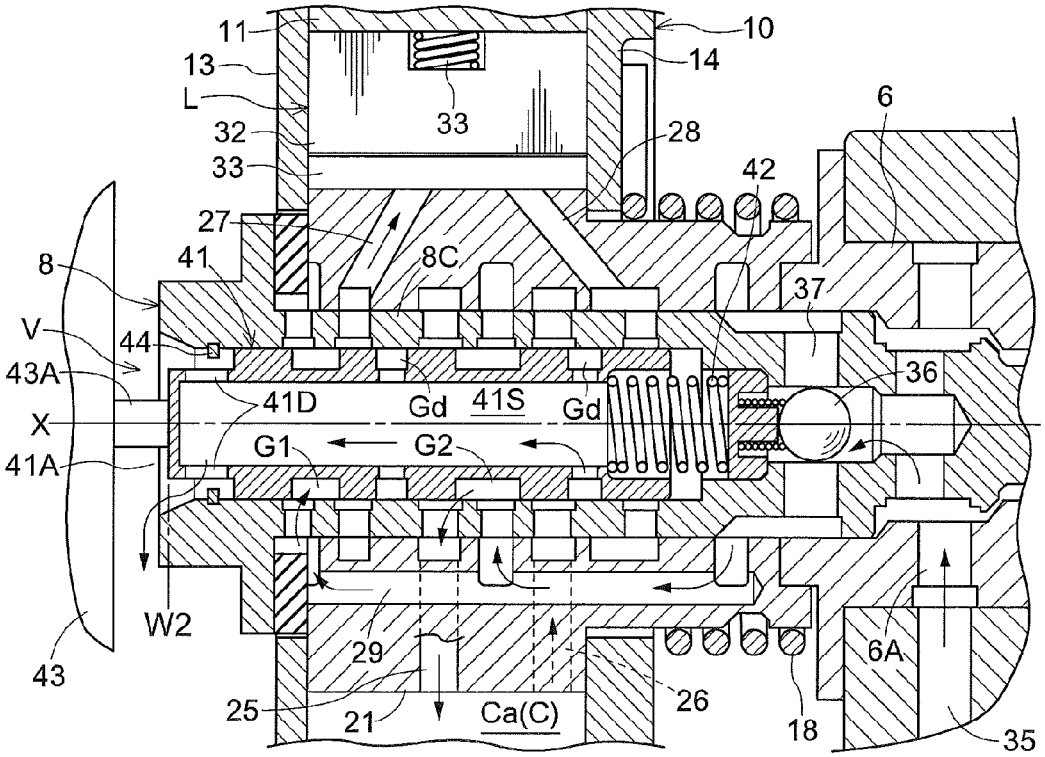
FIG. 6 is a cross-sectional view showing the flow of the working oil when the spool is set in a second position.

In the second position W2, the plunger 43A of the electromagnetic solenoid 43 is in a position where it exerts a pressing force on the pressing wall 41A of the spool 41 and balances with the biasing force of the spool spring 42, and the working oil flows as indicated by the arrows in FIG. 6. Specifically, a pump port, which is in communication with the distribution channels 29, of the tubular portion 8C is in communication with the advancing channels 25 via the second control groove G2 of the spool 41. Moreover, the retarding port, which is in communication with the retarding channels 26, of the tubular portion 8C is in communication with the drain space 41S via a drain groove Gd of the spool 41.

Furthermore, the unlocking port, which is in communication with the unlocking channels 27, of the tubular portion 8C is in communication with a pump port of the tubular portion 8C via the first control groove G1 of the spool 41, and the unlocking port, which is in communication with the lock discharge channels 28, of the tubular portion 8C is closed by the spool 41.

Thus, in a situation in which the engine E is operating and the lock mechanisms L are in the locked state, if the spool 41 is set in the second position W2, the pressure of the working oil supplied from the unlocking channels 27 causes the lock members 32 of the lock mechanisms L to be disengaged from the lock recesses 31, resulting in a transition to the unlocked state. After this unlocking of the lock mechanisms L, the relative rotation phase is displaced in the advance direction Sa. Moreover, if the lock mechanisms L have already been in the unlocked state, the relative rotation phase is displaced in the advance direction Sa while the unlocked state is maintained.

[Control Valve Mechanism: Third Position]

Figure 7:
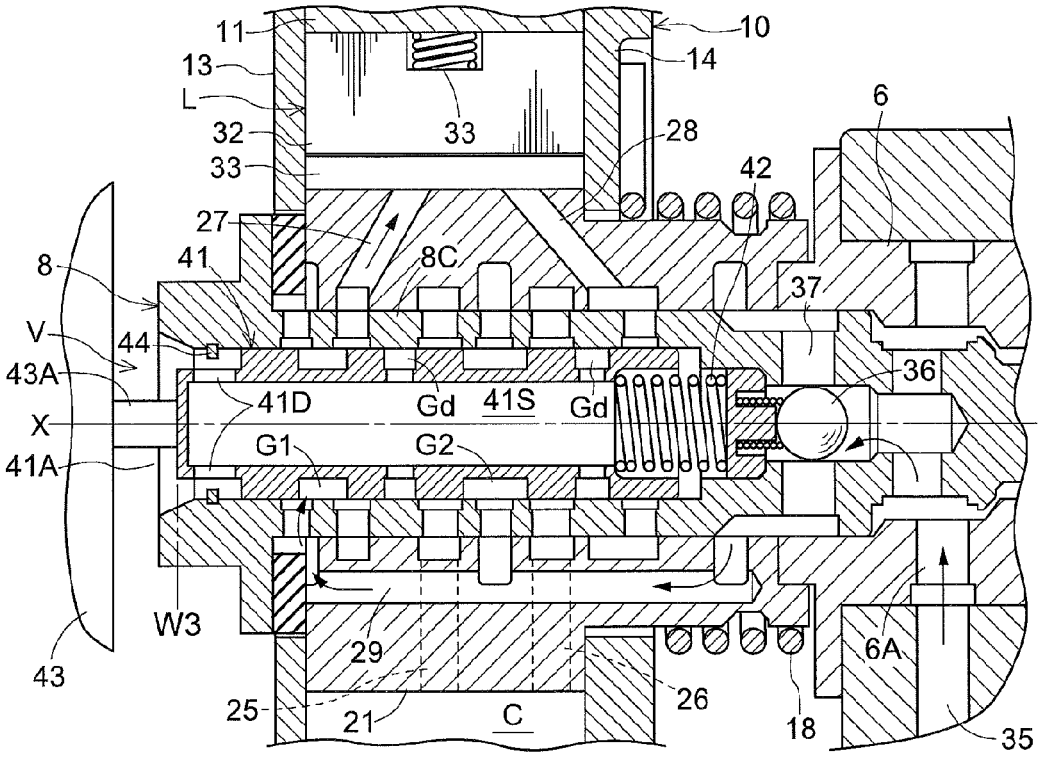
FIG. 7 is a cross-sectional view showing the flow of the working oil when the spool is set in a third position.

In the third position W3, the plunger 43A of the electromagnetic solenoid 43 is in a position where it exerts a pressing force on the pressing wall 41A of the spool 41 and balances with the biasing force of the spool spring 42, and the working oil flows as indicated by the arrows in FIG. 7. Specifically, the two pump ports, which are in communication with the distribution channels 29, of the tubular portion 8C are closed by the spool 41, and the advancing port, which is in communication with the advancing channels 25, and the retarding port, which is in communication with the retarding channels 26, are closed by the spool 41.

Furthermore, the unlocking port, which is in communication with the unlocking channels 27, of the tubular portion 8C is in communication with a pump port of the tubular portion 8C via the first control groove G1 of the spool 41. The unlocking port, which is in communication with the lock discharge channels 28, of the tubular portion 8C is closed by the spool 41.

Thus, if the spool 41 is set in the third position W3, the lock mechanisms L are maintained in the unlocked state, but the displacement of the relative rotation phase is suppressed.

[Control Valve Mechanism: Fourth Position]

Figure 8:
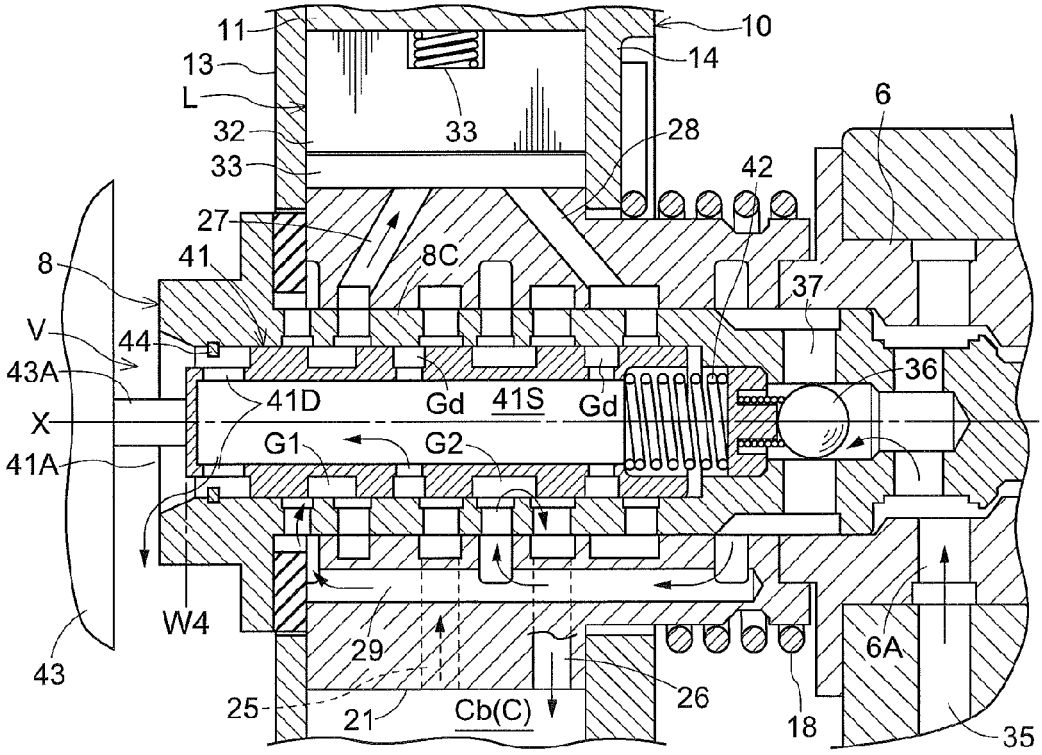
FIG. 8 is a cross-sectional view showing the flow of the working oil when the spool is set in a fourth position.

In the fourth position W4, the plunger 43A of the electromagnetic solenoid 43 is in a position where it exerts a pressing force on the pressing wall 41A of the spool 41 and balances with the biasing force of the spool spring 42, and the working oil flows as indicated by the arrows in FIG. 8. Specifically, a pump port, which is in communication with the distribution channels 29, of the tubular portion 8C is in communication with the retarding channels 26 via the second control groove G2 of the spool 41. Moreover, the advancing port, which is in communication with the advancing channels 25, of the tubular portion 8C is in communication with the drain space 41S via a drain groove Gd of the spool 41.

Furthermore, the unlocking port, which is in communication with the unlocking channels 27, of the tubular portion 8C is in communication with a pump port of the tubular portion 8C via the first control groove G1 of the spool 41, and the unlocking port, which is in communication with the lock discharge channels 28, of the tubular portion 8C is closed by the spool 41.

Thus, in a situation in which the engine E is operating and the lock mechanisms L are in the locked state, if the spool 41 is set in the fourth position W4, the pressure of the working oil supplied from the unlocking channels 27 causes the lock members 32 of the lock mechanisms L to be disengaged from the lock recesses 31, and thus the lock mechanisms L are transitioned to the unlocked state. After this unlocking of the lock mechanisms L, the relative rotation phase is displaced in the retard direction Sb. Moreover, if the lock mechanisms L have already been in the unlocked state, then in the unlocked state, the relative rotation phase is displaced in the retard direction Sb.

[Control Valve Mechanism: Fifth Position]

Figure 9:
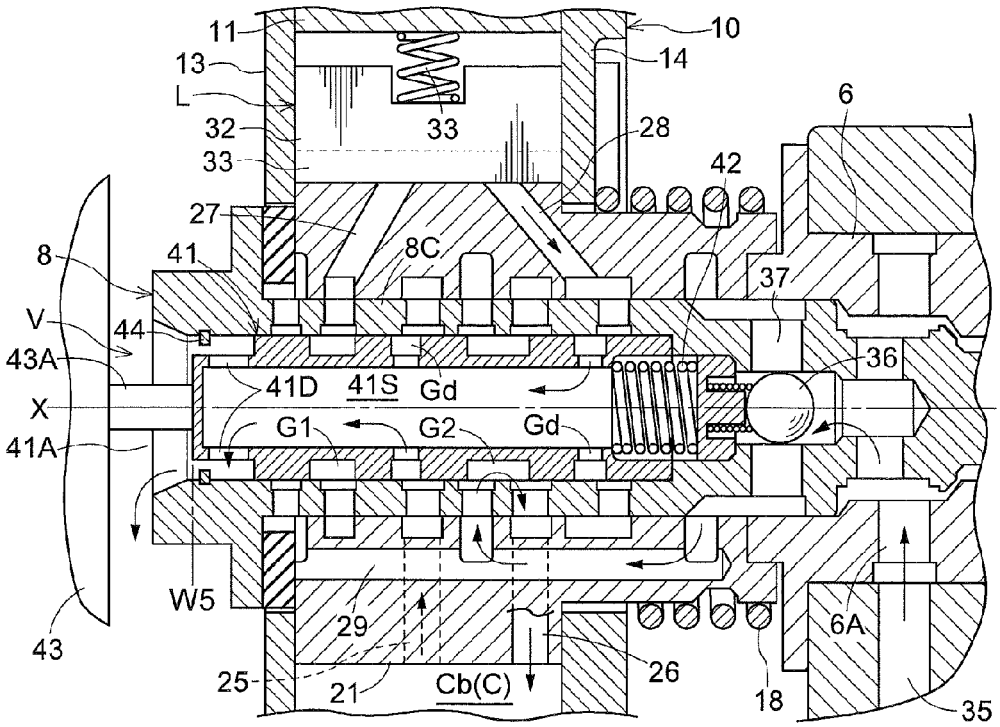
FIG. 9 is a cross-sectional view showing the flow of the working oil when the spool is set in a fifth position.

In the fifth position W5, the plunger 43A of the electromagnetic solenoid 43 exerts a pressing force on the pressing wall 41A of the spool 41, and an inward end of this spool 41 has reached a moving limit at which it abuts against an abutment surface of the fixing bolt 8, and the working oil flows as indicated by the arrows in FIG. 9. Specifically, a pump port, which is in communication with the distribution channels 29, of the tubular portion 8C is in communication with the retarding channels 26 via the second control groove G2 of the spool 41. Moreover, the advancing port, which is in communication with the advancing channels 25, of the tubular portion 8C is in communication with the drain space 41S via a drain groove Gd of the spool 41.

Furthermore, the unlocking port, which is in communication with the unlocking channels 27, of the tubular portion 8C is closed by the spool 41, and the unlocking port, which is in communication with the lock discharge channels 28, of the tubular portion 8C is in communication with the drain space 41S via a drain groove Gd of the spool 41.

Thus, in a situation in which the engine E is operating and the lock mechanisms L are in the unlocked state, if the spool 41 is set in the fifth position W5, the relative rotation phase is displaced in the retard direction Sb. When the relative rotation phase has reached the intermediate locked phase Pm due to this displacement, the lock mechanisms L are transitioned to the locked state. Moreover, if the lock mechanisms L have already been in the locked state, the locked state is maintained.

[Engine Control Unit]

As shown in FIG. 1, the engine control unit 50 is configured to acquire information from a plurality of sensors and the like and to output a control signal to the electromagnetic solenoid 43 and a control system of the engine E.

The engine E is provided with a rotation speed sensor RS that detects the rotation speed (number of revolutions within a unit time) of the crankshaft 1 and a temperature sensor TS that detects the temperature of the engine E. The valve opening/closing timing control unit A is provided with a phase sensor PhS that detects the relative rotation phase. The channel through which the working oil is supplied from the hydraulic pump P is provided with an oil pressure sensor PrS that detects the pressure of the working oil. The vehicle is provided with a start/stop switch 55 that starts and stops the engine E. The engine control unit 50 is provided with an input system that acquires signals from these sensors and the switch.

Moreover, the engine E is provided with a starter motor M that starts the engine E. The engine control unit 50 is provided with an output system that outputs a control signal to the starter motor M and that outputs a control signal for controlling the electromagnetic solenoid 43.

The engine control unit 50 includes a start controller 51 that starts the engine E, a phase controller 52 that controls the relative rotation phase of the valve opening/closing timing control unit A, and a stop controller 53 that stops the engine E.

Although the start controller 51, the phase controller 52, and the stop controller 53 are configured by software, these controllers may partly be configured by hardware such as a logic, or may all be configured by hardware.

[Mode of Control]

When the engine E is operating, the phase controller 52 of the engine control unit 50 controls the relative rotation phase of the valve opening/closing timing control unit A based on information from the rotation speed sensor RS, the temperature sensor TS, the oil pressure sensor PrS, and the like. At this time, the electromagnetic solenoid 43 of the control valve mechanism V is controlled in such a manner that a target relative rotation phase is set, and a relative rotation phase detected by the phase sensor PhS is fed back.

Figure 10:
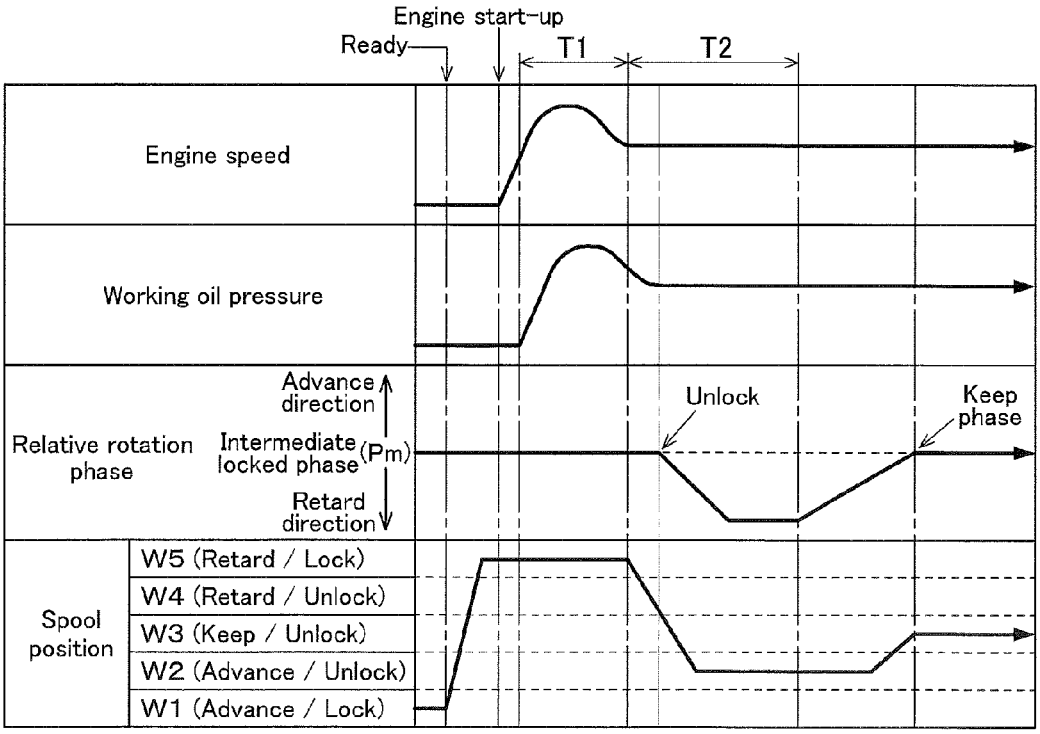
FIG. 10 is a chart showing engine speed, working oil, and the like during start-up of an engine.
Figure 11:
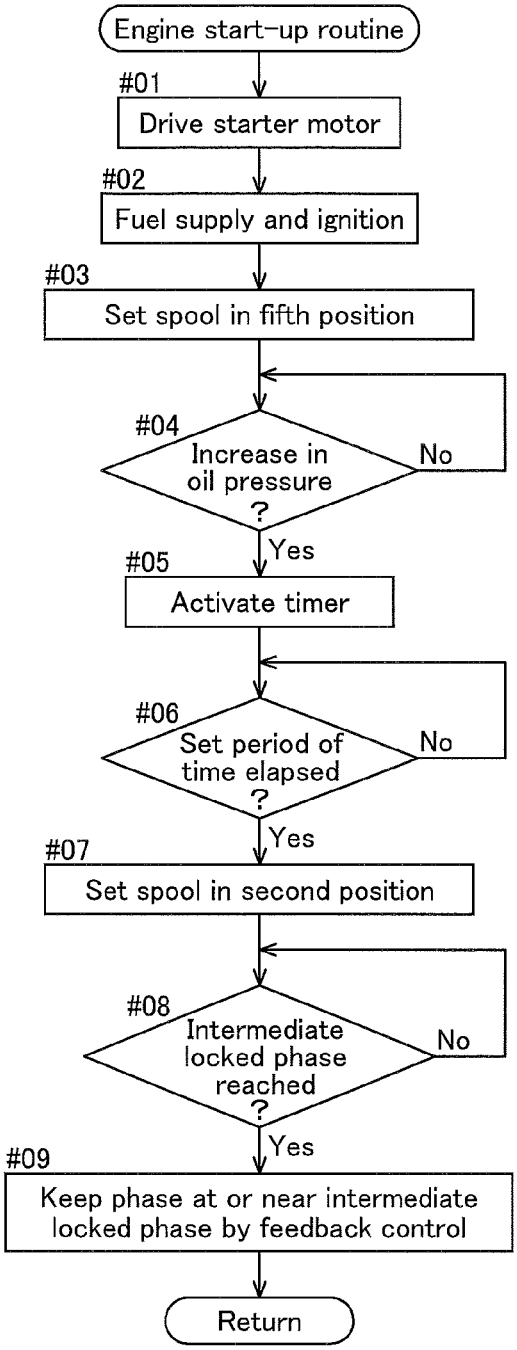
FIG. 11 is a flowchart of an engine start-up routine.

Next, in the case where the engine E is started by operating the start/stop switch 55, control of an engine start-up routine shown in the flowchart of FIG. 11 is executed. During this control, the position of the spool 41 is set as shown in FIG. 10, and the rotation speed of the engine E, the working oil pressure detected by the oil pressure sensor PrS, and the relative rotation phase detected by the phase sensor PhS are changed accordingly.

That is to say, the starter motor M is driven, fuel is supplied to a combustion chamber, an air-fuel mixture is ignited by an ignition plug, and the spool 41 is set in the fifth position W5 (steps #01 to #03).

With this configuration, before the start/stop switch 55 is operated, the spool 41 is in the first position W1. Then, when the start/stop switch 55 is operated, the spool 41 is set in the fifth position W5 (at the timing "Ready"), and cranking is started by the driving of the starter motor M.

Next, the engine E is started by the cranking, a timer is activated at the time when an increase in the working oil pressure is detected by the oil pressure sensor PrS, and the spool 41 is maintained in the fifth position W5 until a set period of time elapses. Then, at the time when this set period of time has elapsed, the spool 41 is set in the second position W2 (steps #04 to #07).

As described above, the fifth position W5 is the position that allows the working oil to be supplied to the retarding chambers Cb while the lock mechanisms L are maintained in the locked state. Moreover, the set period of time is a period of time within which the retarding chambers Cb can be completely filled with the working oil (period of time within which the filling is completed), and is indicated by time T1 in FIG. 10. Thus, the state in which the relative rotation phase is maintained at the intermediate locked phase Pm is maintained for the set period of time (time T1), and the retarding chambers Cb are completely filled with the working oil when this set period of time (time T1) has elapsed. Immediately after that, the spool 41 is set in the second position W2. It is also possible to set the mode of control such that this set period of time is changed based on the oil temperature of the working oil. Specifically, the mode of control may be set such that calculation is performed in such a manner that the higher the oil temperature, the shorter the set period of time, or information on the set period of time is read from a table in which the relationship between the oil temperature and the set period of time is stored. As a result, even in the case where the viscosity of the working oil changes depending on the oil temperature, the locked state can be released at the point in time when a required amount of working oil is filled. Moreover, the period of time within which the filling can be completed may also vary depending on the oil type. The set period of time for a high-viscosity working oil is longer than that for a low-viscosity working oil. Accordingly, a period of time within which a working oil having the highest viscosity corresponding to an engine E that is used can be filled may be set as the set period of time. Alternatively, the mode of control may be set such that this set period of time is changed based on the temperature of a coolant (a specific example of a second fluid).

As a result of the spool 41 being set in the second position W2, the working oil is supplied to the unlocking channels 27, and the two lock members 32 of the lock mechanisms L are disengaged from the corresponding lock recesses 31 at the timing "Unlock" shown in FIG. 10. In this second position W2, while the working oil from the retarding chambers Cb is in a dischargeable state, the working oil is supplied to the advancing chambers Ca. Supplying the working oil to the advancing chambers Ca in this manner suppresses the problem of the relative rotation phase being displaced in the retard direction Sb even when the torque of the camshaft exerted from the intake camshaft 6 is acting to displace the relative rotation phase in the retard direction Sb.

It should be noted that during an early stage after the spool 41 is set in the second position W2, the amount of working oil that is supplied to the advancing chambers Ca is not sufficient. Thus, as shown in FIG. 10, the relative rotation phase is gradually displaced in the retard direction Sb due to the torque of the camshaft exerted from the intake camshaft 6.

This control by which the working oil is supplied to the advancing chambers Ca after the working oil is supplied to the retarding chambers Cb is a specific example of fluid filling control, and the control by which the locked state of the lock mechanisms L is released by setting the spool 41 in the second position W2 is a specific example of unlock control.

In particular, during start-up of the engine E, the torque of the intake camshaft 6 acts to displace the relative rotation phase of the valve opening/closing timing control unit A in the retard direction Sb. In this embodiment, the retarding chambers Cb are first filled with the working oil. This eliminates the problem of the relative rotation phase significantly changing due to the torque exerted from the intake camshaft 6 after the locked state of the lock mechanisms L is released. At the point in time when the locked state of the lock mechanisms L is released, the working oil is continuously supplied to the advancing chambers Ca. Thus, even immediately after the release of the locked state, the problem of the relative rotation phase being rapidly displaced in the retard direction Sb is suppressed.

Moreover, the fuel that has not been burned immediately after start-up of the engine E is discharged as unburned HC. The amount of this unburned HC increases to the maximum (reaches the peak) at the point in time when a predetermined period of time has elapsed from the start-up of the engine E. Since the intermediate locked phase Pm also serves as the phase that suppresses the amount of unburned HC that is generated, it is desirable that the timing of the release of the locked state of the lock mechanisms L is the timing after a decrease in (after passing the peak of) the amount of unburned HC that is generated. For this reason, the set period of time (time T1) is set to timing after a transition to a downward tendency of the amount of unburned HC that is generated.

Moreover, when the spool 41 is set in the second position W2 as described above, the pressure of the advancing chambers Ca is low, and the relative rotation phase is not displaced in the advance direction Sa. Therefore, the working oil filled in the retarding chambers Cb is not rapidly discharged.

Then, after this spool 41 is set in the second position W2, and the locked state of the lock mechanisms L is released, the supply of the working oil to the advancing chambers Ca is completed after a lapse of a predetermined period of time, and the relative rotation phase starts being displaced in the advance direction Sa. As a result of this displacement, the relative rotation phase reaches the intermediate locked phase Pm, and at the timing indicated by "Keep phase" in FIG. 10, control for keeping the relative rotation phase at or near the intermediate locked phase Pm by feedback is performed, and the start-up control of the engine E is ended (steps #08 and #09). As a specific mode of control, at the timing indicated by "Keep phase", control for setting the spool 41 of the control valve mechanism V in the third position W3 is performed. However, in order to keep the relative rotation phase at the intermediate locked phase Pm, the spool 41 is not necessarily required to be set in the third position W3, and may also be set in the third position W3 or a region near the third position W3.

It should be noted that it is possible to activate the timer again immediately after the set period of time has elapsed and to specify a period of time until the advancing chambers Ca are completely filled with the working oil as time T2 in FIG. 10. When this time T2 has elapsed, the relative rotation phase starts changing in the advance direction Sa, and in this state, phase control (control by the phase controller 52) for feeding back a detection signal of the phase sensor PhS is possible.

[Effects of Embodiment]

When the engine E is started in the above-described manner, the retarding chambers Cb are filled with the working oil, and after this filling of the retarding chambers Cb, the supply of the working oil to the advancing chambers Ca is started, and the locked state of the lock mechanisms L is released before this filling of the advancing chambers Ca with the working oil is completed. Performing such control makes it possible to reduce the time from the start-up of the engine E to the unlocking when compared with a case where, for example, the advancing chambers Ca and the retarding chambers Cb are completely filled with the working oil.

In addition, at the point in time when the lock mechanisms L are transitioned to the unlocked state, the retarding chambers Cb are in a state in which these chambers have already been filled with the working oil. Thus, regardless of whether an external force is exerted in a direction in which the volume of the retarding chambers Cb is compressed or a direction in which the volume of the retarding chambers Cb is expanded, the working oil prevents a change in the volume, and the problem of the relative rotation phase significantly changing is eliminated. Moreover, at the time when the locked state of the lock mechanisms L is released, the supply of the working oil to the advancing chambers Ca is continued. Thus, it is also possible to suppress the phenomenon of the relative rotation phase being significantly displaced in the retard direction Sb even in a situation in which the torque of the camshaft exerted from the intake camshaft 6 is acting in the retard direction Sb.

Moreover, since the timing of the release of the locked state of the lock mechanisms L is set to be after the amount of unburned HC that is discharged passes its peak, the unburned HC does not increase even when control for releasing the locked state of the lock mechanisms L is performed in an early stage.

In the control valve mechanism V that uses a single spool 41, it is structurally difficult to create a position that only allows the supply/discharge of the working oil to/from the lock mechanisms L. Thus, as shown in the foregoing embodiment, a configuration is adopted in which the supply/discharge of the working oil to/from the lock mechanisms L is performed simultaneously with the supply/discharge of the working oil to/from the advancing chambers Ca and the retarding chambers Cb.

Moreover, if the control valve mechanism V is configured including a phase control valve that controls the relative rotation phase and a lock control valve that controls locking of the lock mechanisms L, control of the lock mechanisms L can be performed at any desired timing. Thus, control is easy when unlocking the lock mechanisms L before completion of the filling of the working oil. However, since this configuration includes the phase control valve and the lock control valve, the number of parts increases, and this results in an increase in the cost.

In contrast, as shown in the foregoing embodiment, setting the mode of control by the engine control unit 50 such that the fluid-filling control and the unlock control can be performed makes it possible to release the locked state of the lock mechanisms L after either the advancing chambers Ca or the retarding chambers Cb are filled with the working oil (fluid). As a result, the phenomenon of the relative rotation phase significantly changing during start-up of the engine E is well suppressed.

[Other Embodiments]

In addition to the foregoing embodiment, the present invention may also be configured as described below.

(a) The control valve mechanism V may be constituted by two types of control valves, that is, a phase control valve that performs the supply/discharge of the fluid (working oil) to/from the advancing chambers Ca and the retarding chambers Cb, and a lock control valve that performs the supply/discharge of the unlocking fluid (working oil) to/from the lock mechanisms L. With this configuration, the timing of the release of the locked state of the lock mechanisms L can be set as desired.

(b) With respect to the control valve mechanism V, instead of the configuration in which the fluid (working oil) is directly supplied to and discharged from a central position of the valve opening/closing timing control unit A, a configuration may be adopted in which the supply/discharge of the fluid is performed from an outer circumference of the valve opening/closing camshaft via a rotary joint. This configuration may allow a certain amount of increase in the size of the control valve mechanism V and can also improve the ease of maintenance.

(c) Regardless of whether the configuration in which the control valve mechanism V is constructed using a single spool 41 is adopted as in the foregoing embodiment or the configuration in which the control valve mechanism V is constructed using a component for phase control is adopted as in the other embodiment (a) described above, a filling position that enables simultaneous supply of the fluid (working oil) to the advancing chambers Ca and the retarding chambers Cb may be set. Although this filling position may be set only during start-up of the internal combustion engine (engine E), if a control valve mechanism V of this type is provided, a mode of control in which, for example, the locked state of the lock mechanisms L is released at the time when the advancing chambers Ca and the retarding chambers Cb are not completely filled with the fluid may be achieved.

(d) Instead of the control by which, as described in the foregoing embodiment, the fluid (working oil) is supplied to the advancing chambers Ca after the retarding chambers Cb are filled with the fluid, the sequence of the fluid-filling control may be set in reverse such that the supply of the fluid to the retarding chambers Cb is started after the advancing chambers Ca are filled with the fluid. Setting the sequence of filling of the working oil in this manner may make it possible to substantially prevent the relative rotation phase of the valve opening/closing timing control unit A from changing even in a situation in which the torque from the camshaft is acting during start-up of the engine E.

INDUSTRIAL APPLICABILITY

The present invention can be used for a valve opening/closing timing control device that controls the relative rotation phase of a driven rotating body with respect to a driving rotating body that rotates synchronously with a drive shaft of an internal combustion engine.

REFERENCE SIGNS LIST

1 Drive shaft (crankshaft)
6 Camshaft (intake camshaft)
10 Driving rotating body (outer rotor)

20 Driven rotating body (inner rotor)
41 Spool
43 Electromagnetic solenoid
50 Controller (engine control unit)
C Fluid pressure chamber
Ca Advancing chamber
Cb Retarding chamber
E Internal combustion engine (engine)
L Lock mechanism
Pm Locked phase (intermediate locked phase)
V Control valve mechanism

The invention claimed is:

1. A valve opening/closing timing control device comprising:

a driving rotating body that rotates synchronously with a drive shaft of an internal combustion engine;

a driven rotating body that is disposed coaxially with the driving rotating body and that rotates integrally with a camshaft for opening/closing a valve of the internal combustion engine;

a lock mechanism that is configured to switch between a locked state in which a relative rotation phase of the driving rotating body and the driven rotating body is kept at a predetermined locked phase and an unlocked state;

a fluid pressure chamber that is defined between the driving rotating body and the driven rotating body;

a control valve mechanism that controls supply of a fluid to an advancing chamber and a retarding chamber, of the fluid pressure chamber, the supply to the advancing chamber causing the relative rotation phase to be displaced in an advance direction, and the supply to the retarding chamber causing the relative rotation phase to be displaced in a retard direction, and that controls supply of the fluid for controlling the lock mechanism; and a controller that controls the control valve mechanism, wherein during start-up of the internal combustion engine, the controller performs unlock control for releasing the locked state of the lock mechanism before filling of the advancing chamber and the retarding chamber with the fluid by fluid-filling control is completed.

2. The valve opening/closing timing control device according to claim 1, wherein a filling order of the fluid-filling control is set such that after filling of either one of the advancing chamber and the retarding chamber with the fluid is completed, filling of the other of the advancing chamber and the retarding chamber with the fluid is started, and the unlock control is performed such that after the filling of either one of the advancing chamber and the retarding chamber with the fluid is completed and before the filling of the other of the advancing chamber and the retarding chamber is completed, the fluid is supplied in a direction in which the lock mechanism is unlocked.

3. The valve opening/closing timing control device according to claim 2, wherein after the unlock control, the controller controls the control valve mechanism such that the fluid is supplied to either the advancing chamber or the retarding chamber, the fluid supplied to said advancing chamber or retarding chamber acting against a direction of a displacement of the relative rotation phase due to a torque of the camshaft that is exerted from the camshaft.

4. The valve opening/closing timing control device according to claim 1, wherein after the unlock control, the controller controls the control valve mechanism such that the relative rotation phase is maintained at the locked phase.

5. The valve opening/closing timing control device according to claim 1, wherein after the start-up of the internal combustion engine, the controller starts the unlock control at the time when a peak of discharge of unburned HC is passed.

6. The valve opening/closing timing control device according to claim 1, wherein the control valve mechanism includes a spool, a spool spring that biases the spool, and an electromagnetic solenoid that is operable to move the spool.

7. A valve opening/closing timing control device comprising:

a driving rotating body that rotates synchronously with a drive shaft of an internal combustion engine;

a driven rotating body that is disposed coaxially with the driving rotating body and that rotates integrally with a camshaft for opening/closing a valve of the internal combustion engine;

a lock mechanism that is configured to switch between a locked state in which a relative rotation phase of the driving rotating body and the driven rotating body is kept at a predetermined locked phase and an unlocked state;

a fluid pressure chamber that is defined between the driving rotating body and the driven rotating body;

a control valve mechanism that controls supply of a first fluid to an advancing chamber and a retarding chamber, of the fluid pressure chamber, the supply to the advancing chamber causing the relative rotation phase to be displaced in an advance direction, and the supply to the retarding chamber causing the relative rotation phase to be displaced in a retard direction, and that controls supply of the first fluid for controlling the lock mechanism; and a controller that controls the control valve mechanism, wherein the controller performs unlocking at a point in time when a period of time of filling for which either the advancing chamber or the retarding chamber is filled with the first fluid from start-up of the internal combustion engine exceeds a set period of time that is set during the start-up of the internal combustion engine in accordance with the temperature of the first fluid or a second fluid for use in adjustment of the temperature of the internal combustion engine and before filling of the advancing chamber and the retarding chamber with the fluid by fluid-filling control is completed.

8. The valve opening/closing timing control device according to claim 7, wherein the control valve mechanism includes a spool, a spool spring that biases the spool, and an electromagnetic solenoid that is operable to move the spool.

* * * * *